US011241876B2

(12) United States Patent
Weissbacher et al.

(10) Patent No.: US 11,241,876 B2
(45) Date of Patent: Feb. 8, 2022

(54) METHOD FOR CONTROLLING THE DRIVE OF A MACHINE

(71) Applicant: B&R INDUSTRIAL AUTOMATION GMBH, Eggelsberg (AT)

(72) Inventors: Joachim Weissbacher, Bergheim (AT); Robert Kickinger, Bergstetten (AT); Albert Tresens, Santa Coloma de Gramenet (ES)

(73) Assignee: B&R INDUSTRIAL AUTOMATION GMBH, Eggelsberg (AT)

( * ) Notice: Subject to any disclaimer, the term of this patent is extended or adjusted under 35 U.S.C. 154(b) by 257 days.

(21) Appl. No.: 16/327,574

(22) PCT Filed: Aug. 23, 2016

(86) PCT No.: PCT/EP2016/069908
§ 371 (c)(1),
(2) Date: Feb. 22, 2019

(87) PCT Pub. No.: WO2018/036619
PCT Pub. Date: Mar. 1, 2018

(65) Prior Publication Data

US 2019/0176463 A1 Jun. 13, 2019

(51) Int. Cl.
*B41F 33/16* (2006.01)
*B41F 33/00* (2006.01)

(52) U.S. Cl.
CPC ..... *B41F 33/16* (2013.01); *B41F 33/00* (2013.01); *B41P 2200/12* (2013.01)

(58) Field of Classification Search
CPC ..... B41F 33/16; B41F 33/00; B41F 31/04; B41P 2200/12; B41P 2213/70; B41P 2213/71; D21G 1/008; G03G 15/5008
See application file for complete search history.

(56) References Cited

U.S. PATENT DOCUMENTS

| | | | | |
|---|---|---|---|---|
| 5,542,353 | A | 8/1996 | Cuir et al. | |
| 10,391,760 | B2 * | 8/2019 | Westhof | B41F 5/24 |
| 2014/0196619 | A1 | 7/2014 | Kang et al. | |

FOREIGN PATENT DOCUMENTS

| | | |
|---|---|---|
| CN | 1125174 | 6/1996 |
| CN | 1172728 | 2/1998 |

(Continued)

OTHER PUBLICATIONS

China Search Report conducted in counterpart China Appln. No. 201680088622.1 (dated Apr. 28, 2020) (with translation).

(Continued)

*Primary Examiner* — Leslie J Evanisko
*Assistant Examiner* — Leo T Hinze
(74) *Attorney, Agent, or Firm* — Greenblum & Bernstein, P.L.C.

(57) ABSTRACT

A method for controlling a drive of a machine having at least one first roll element, which rolls with a surface on a counter surface at least in subintervals of a revolution cycle with the action of a contact force under elastic deformation, that includes a speed correction method, which automatically compensates for deformation-related deviations of the peripheral velocity of the first roll element by way of an adaptation of the setpoint value for the velocity of the first roll element, and a retrospective method, which automatically compensates for deviations of the speed consistency of the first roll element within a revolution cycle by applying a correction signal determined from the curve of a control variable, in particular an actual velocity or actual position of the first roll element, in a preceding revolution cycle or in multiple preceding revolution cycles, are applied in combination.

22 Claims, 9 Drawing Sheets

(56) References Cited

FOREIGN PATENT DOCUMENTS

| | | | | |
|---|---|---|---|---|
| CN | 1607088 | | 2/2005 | |
| CN | 101024329 | | 8/2007 | |
| CN | 102187349 | | 9/2011 | |
| CN | 103003071 | | 3/2013 | |
| CN | 103158333 | | 6/2013 | |
| CN | 203358032 | | 12/2013 | |
| CN | 103962391 | | 8/2014 | |
| CN | 104139608 | | 11/2014 | |
| CN | 104321851 | | 1/2015 | |
| CN | 105531721 | | 4/2016 | |
| DE | 101 07 135 | | 8/2002 | |
| DE | 10 2012 013 532 | | 1/2017 | |
| DE | 10 2012 013532 | | 1/2017 | |
| EP | 1 759 839 | | 3/2007 | |
| JP | 3-133503 | | 6/1991 | |
| JP | 2007-69606 | | 3/2007 | |
| WO | WO-2015032518 | A1 * | 3/2015 | ..... B41F 31/004 |

OTHER PUBLICATIONS

Japan Office Action conducted in counterpart Japan Appln. No. 2019-510777 (dated Sep. 16, 2020) (with translation).
Int'l Search Report & Written Opinion conducted in Int'l Appln. No. PCT/EP2016/069908 (dated Jul. 6, 2017) (w/ English translation).

* cited by examiner

METHOD FOR CONTROLLING THE DRIVE OF A MACHINE

The present invention relates to a method for controlling the drive of a machine having at least one roll element, which rolls with the surface on a counter surface at least in subintervals of a revolution cycle with action of a contact force under elastic deformation.

Due to the action of the contact force, a body, which is referred to hereafter in a nonrestrictive manner as a roll element, is elastically deformed when it rolls on a counter surface. The respective effectively acting radius of the roll element changes due to this elastic deformation. When two roll elements roll on one another, both radii change and thus also, jointly with the roll speed, the linear velocity of a product which is transported through the roll pair.

"Roll elements" refers in general in the context of the present disclosure to machine elements which rotate about a fixed or moving axis. The roll elements can be essentially cylindrical or can be formed as profile rolls.

In general, the velocity of the roll surface or the relative velocity of roll surfaces rolling on one another, respectively, is set by specifying a setpoint speed for the rolls. Since the effective radii under the effect of a contact force are not known a priori, a torque exchange occurs between the rolls as a result of the elastic deformation. This means that one roll exerts an accelerating torque on the other roll, while the other roll exerts a braking torque on the first.

In addition, periodic disturbances of the movement (interfering torques) occur in practice. Examples of such interferences are, for example, a printing plate which is attached to one of the rolls and does not enclose the entire circumference of the roll, and also the printed motif which is applied to this printing plate.

Methods of the type mentioned at the outset are used, for example, in rotation printing methods using elastic printing forms, for example, the flexographic printing method. Numerous problems can occur in this case in the printing daily routine, the handling and solving of which by the operator of the printing press requires good training and a large amount of experience. The occurrence of horizontal stripes in the printed image is such an undesired phenomenon in flexographic printing and these horizontal stripes are among the well-known problems in daily routine printing.

If the printing form does not completely cover the circumference of the form cylinder, it is thus known that the gap in the region of the surface of the form cylinder which is not covered by the printing form can cause vibrations in the printing stock, which have a negative effect on the printed image. These vibrations arise each time the printing form comes into contact with the anilox roll or the counter pressure cylinder or disengages this contact again.

Furthermore, the geometrical shape of the printing form surface defined by the printing motif can cause motif-excited vibrations, which also have a negative effect on the printed image.

Although such vibrations play a role, the exact causes for horizontal stripes in the printed image are often not simple to determine, so that measures for preventing them usually have to be found by trial and error. In printing practice, attempts are made in this case to suppress this undesired appearance by way of various measures, for example, changing the print infeed, changing the printed image length, allocating a printing ink onto multiple printing mechanisms, manually changing roll diameters on the operating device of the machine controller, using special sleeves and adapters, suitable selection of the adhesive tape, etc.

However, all of these measures require manual interventions specifically adapted to the respective printing task by experienced operating personnel of the printing press, or they already have to be taken into consideration during the printing form production.

DE 10 2012 013532 A1 discloses a method, in which the printing gap between printing form and printed material is moved to full contact. Due to the extremely low relief depth on the entire surface, very narrow tolerances have to be maintained in this case, which can prove to be difficult in practice.

DE 69400403 T2 discloses a printing method, wherein an instantaneous intensity or a motor torque of a drive motor is measured and the rotational velocities of printing cylinders are set in such a way that as a rubber element moves through between a first and a second cylinder, on the one hand, and between a first and third cylinder, on the other hand, a minimal change of the instantaneous intensity or the motor element is effectuated.

There is furthermore a demand for methods and devices for improving the processing quality and in particular for avoiding horizontal stripes in a printed image, which are to function as independently as possible from the experience of the operator. If possible, the method is not to require any additional effort during the production preparation and/or refitting, for example, during the printing form production, and is to be simple to implement.

These and further objects are achieved according to the invention by a method of the type mentioned at the outset, in which a speed correction method, which automatically compensates for deformation-related deviations of the peripheral velocity of the first roll element by an adaptation of the setpoint value for the velocity of the first roll element, and a retrospective method, which automatically compensates for deviations of the speed consistency of the first roll element within a revolution cycle by applying a correction signal determined from the curve of a control variable, in particular an actual velocity or an actual position of the roll element, in one or more preceding revolution cycle or cycles, are applied in combination. It was established by the inventor in experiments that the quality problems were not to be remedied with the application of a speed correction method alone, or with the application of a retrospective method for increasing the speed consistency alone. A quality increase was only able to be achieved by the combined application of these two methods, which was not to be expected as a result of the disappointing results which were achieved by the individual methods alone. The method according to the invention has the advantage that it is easily implementable even in existing machines.

In conjunction with the present disclosure, the term "be in contact" of a roll element with a counter surface or of roll pairs with one another is understood not only as a direct contact, but rather also a contact with a product interposed, in particular a printed material, which is guided through between a roll pair during printing, for example. Furthermore, the term "be in contact" does not necessarily mean that the roll element is in contact with the counter surface during the entire revolution time.

The term "roll with elastic deformation on a counter surface" is understood in conjunction with the present invention to mean that the surfaces of the elements rolling on one another bear on one another essentially without sliding at least in the contact region.

The term "contact region" refers in conjunction with the present invention to the region in which a roll pair (or a roll element and a surface, respectively) are in contact, possibly with a product or printed material interposed. In the case of an idealized, rigid roll pair, the contact region can be represented in cross section as a "contact point." Surface velocities or relative velocities, for example, are generally related to a computed contact point, wherein it is clear to a person skilled in the art that in real, elastically deformable rolls, these are contact surfaces in this case. The terms "contact region" and "contact point" can therefore generally be used synonymously.

"Revolution cycle" refers in conjunction with the present invention to the time span in which the characteristic value peaks of the control variable typically repeat cyclically, wherein the revolution cycle can correspond in particular to the revolution duration of the first roll element or another roll element.

For example, the speed (or a value derived from the speed, such as the peripheral velocity) of the roll element can be used as the control variable. The speed is generally derived in this case from a rotational angle signal, which is generated by a rotary encoder on the drive motor or on the roll element. Value peaks of the deviation of the control variable, which regularly occur at specific points of the revolution cycle, are compensated for by the correction signal by way of the retrospective method for enhancing the speed consistency. Instead of the control variable per se, the correction signal can also be derived from a variable influenced by the control variable.

The method according, to the invention will be described in conjunction with the present disclosure on the basis of the speed. However, a person skilled in the art is readily capable of carrying out the method on the basis of the rotational angle (or of rotational positions). The setpoint values are then not represented as constant velocity specifications, but rather as linearly increasing position and/or angle specifications. Such embodiments are considered to be analogous embodiments.

To compensate for the dead time of the control loop (i.e., the time delay between controller output and actual cross current at the drive motor), the correction signal has to be "set back" by this dead time, in order to synchronize the correction with the value peaks to be corrected.

The invention is based on the finding that differences of the effective peripheral velocities—originating in the elastic deformation, which results in changed effective roll diameters which are extremely difficult to predict beforehand—of roll pairs represent a cause of quality flaws, for example, of horizontal stripes in a printed image. The same quality flaws can also occur if a roll element rolls in general on a counter surface. The occurrence of these quality flaws can be substantially prevented by eliminating these velocity differences.

In an advantageous manner, the time curve of a value characteristic for a drive torque of the roll arrangement can therefore be determined in at least one of the subintervals for the speed correction method, a parameter for an increase of this value in the subinterval can be derived therefrom, and the guide variable of the peripheral velocity of the first roll element can be adapted as a function of this parameter to minimize the increase.

To recognize a velocity difference between the surface of the first roll element and the counter surface, the curve of the drive torque at the roll element or the curve of a variable proportional to the drive torque, by way of example and non-restrictively, the drive current or the drive power, can advantageously be analyzed in the selected subinterval.

According to a further advantageous embodiment, the value characteristic for the drive torque can be a force applied by the at least one roll element onto the counter surface.

The value characteristic for a drive torque of the roll arrangement can be a parameter representative of a velocity error of the roll element and/or of a drag error between the roll element and the counter surface, by way of example and non-restrictively, an averaged or effective torque, an averaged slope of a torque, an averaged force action (torques evaluated with the roll radius) on the counter surface or on another roll element, respectively, or a total of force actions of roll pairs on one another. Based thereon, the peripheral velocity is adapted in such a way that the representative parameter is minimized in this subinterval.

The derived parameter can furthermore be a value averaged in a subinterval or it can be a possibly smooth slope of the drive torque in the subinterval.

The subinterval can comprise one or more complete revolutions of one of the roll elements. A peripheral velocity of the first roll element can advantageously be adapted by changing the specified value for the speed of this roll element.

In a further advantageous embodiment, a peripheral velocity of the first roll element can be adapted by changing the specified value for the diameter of this roll element. The deviation (for example, in percent) of the specified value from the actual diameter can be analyzed as a characteristic value, for example, to recognize quality problems early, which are signaled by a change of this value.

In a further advantageous embodiment, a peripheral velocity of the first roll element can be adapted by changing the specified value for the infeed of this roll element. The value for the diameters relevant for the relative velocity between two roll elements thus also changes due to elastic deformation. In printing presses, for example, the ink pickup from an anilox roll to a form cylinder and the pressure of the form cylinder on the printed material can advantageously be influenced simultaneously.

A shooting method can advantageously be used to determine the specified value for the speed of a roll element, the specified value for the diameter of the roll element, or the specified value for the infeed of the roll element. The shooting method is an iterative method which can run automatically and in which, proceeding from a starting value, for example, for the specified value of the speed of the roll element, the target parameter associated therewith is determined from the resulting torque curve in the mentioned subinterval. The starting value is subsequently slightly modified and the deviation thus resulting is determined. The optimum operating point is automatically set by successive linear interpolations and extrapolations. The iterations are terminated when the desired operating point has been reached with sufficient accuracy and therefore convergence has been reached.

The retrospective method can advantageously be a self-learning method for controlling cyclic sequences, in particular a repetitive control method. Such methods are well suitable for enhancing the speed consistency. Self-learning methods for controlling cyclic sequences refer in general in conjunction with the present invention to methods in which disturbances (for example, setpoint value deviations or errors) are determined and stored in at least a first cycle, wherein measures for suppressing these disturbances are determined on the basis of the determined disturbances, and wherein these measures are applied in at least one further cycle to suppress corresponding disturbances in this further cycle. Disturbances are suppressed in the best possible self-learning manner by the continuously repeated application of these methods.

The repetitive control method is a well-known method which is described, for example, in the technical article "Repetitive control for systems with uncertain period-time," Maarten Steinbuch, Automatica 38 (2002) 2103-2109. The repetitive control method can be used to minimize the occurrence of interfering variables (which are then also periodic) in periodic processes. The method is self-learning per se due to the continuously repeated application and is therefore very easily applicable. In the present application, it can advantageously be used to enhance the speed consistency, which is achieved, for example, by a self-learning additive current activation.

The retrospective method can advantageously use a speed error, which is possibly scaled with a speed controller amplification, and/or a periodic drag error occurring in the contact point between working roll and counter pressure cylinder as an input signal, wherein switching over between different variants of the determination of a return signal can be provided in the control loop in order to provide multiple alternative operating modes. For example, the return can be a signal determined by a motor encoder and representative of the control variable, or a signal determined by a load encoder and representative of the control variable. The return signal can also be produced by a virtual load encoder, which determines an estimated value for the control variable on the basis of the drive current and the motor torque, for example.

The retrospective method can advantageously pass through an initiation phase over at least one revolution cycle, preferably over at least two revolution cycles. A revolution cycle can correspond in this ease in particular to a revolution of the first roll element (or also another roll element if this defines the revolution cycle), so that it is not necessary in many areas of application to determine the cycle from a signal. After switching on the self-learning method, firstly an internal memory is initiated over the first revolution cycle. In the second revolution cycle (and possibly in further cycles), the method is activated continuously or in steps via a looping-in controller, so that the disturbance suppression is completely active after two cycles (or after two revolutions).

In a further advantageous embodiment of the invention, the counter surface can be formed by the surface of a second roll element, wherein the first roll element and the second roll element roll on one another and wherein the drive of the second roll element is controlled similarly to the first roll element.

The retrospective method can advantageously be used to enhance the speed consistency of a periodic drag error occurring in the contact point between the first roll element and the second roll element as the control variable.

In one advantageous embodiment, in which the machine is a printing press, the first roll element can be a form cylinder, wherein a counter pressure cylinder and an anilox roll on the form cylinder, and wherein an elastic printing form is applied to the form cylinder, which is in contact with the anilox roll and/or the counter pressure cylinder at least during a subinterval of the revolution of the form cylinder. This enables a reliable prevention of horizontal stripes in the printed image.

The present disclosure therefore also relates to a method for controlling a printing press having multiple roll elements, namely at least one form cylinder, an anilox roll, and a counter pressure cylinder, wherein an elastic printing form is applied to the form cylinder, which is in contact with the anilox roll and/or the counter pressure cylinder during at least a subinterval of the revolution of the form cylinder, wherein the curve of a value characteristic for the drive torque of at least one of the roll elements is determined in the subinterval, a parameter is derived therefrom, and the peripheral velocity of at least one of the roll elements is adapted as a function of this parameter.

The subinterval analyzed for the computation is selected in conjunction with the present invention on the basis of the respective machine. In printing presses, in particular the size of the form cylinder, the size, shape, and position of the printing form, and the arrangement of the further roll elements are taken into consideration in this case. The subinterval can be determined on the basis of an analysis of the curve of characteristic values, for example, the drive torque, the measured roll velocity, the velocity error, the drag error, or other suitable characteristic curves, during a test run or during the startup of the printing press and can also comprise one or more complete revolutions.

The selection of the analyzed subinterval is to be performed in such a way that interfering influences are minimized. In a further advantageous embodiment of the invention, the subinterval is therefore selected in such a way that the contact points between the printing form and the anilox roll and between the printing form and the counter pressure cylinder in the subinterval are free of contact changes. This enables a stable analysis of the parameters with minimal interfering influences, "Contact changes" are understood in this case as the coming into contact and the disengagement of the contact between the printing form and another roll element.

In one embodiment of the method according to the invention, the method can be executed automatically and optionally also regularly during the printing procedure. This enables an automatic elimination of peripheral velocity differences between roll pairs in contact and the printed image errors linked thereto. An automatic method may thus be provided, which runs in a manner independently controlled by the machine software. In this case, no manual interaction by the operating personnel is necessary, no additional work in the printing preliminary stage is necessary, and additional printing units do not have to be used. The feature of the automatic and optionally also regular execution of the method can also be applied according to the invention to machines which are not printing presses.

In one advantageous embodiment, an identical linear velocity can be set on a machine having multiple printing mechanisms by the adaptation of the peripheral velocity (velocities). This feature can also be applied similarly to other machines.

The present invention will be explained in greater detail hereafter with reference to FIGS. 1 to 8, which show exemplary, schematic, and nonrestrictive advantageous embodiments of the invention. In the figures.

Figure 11:
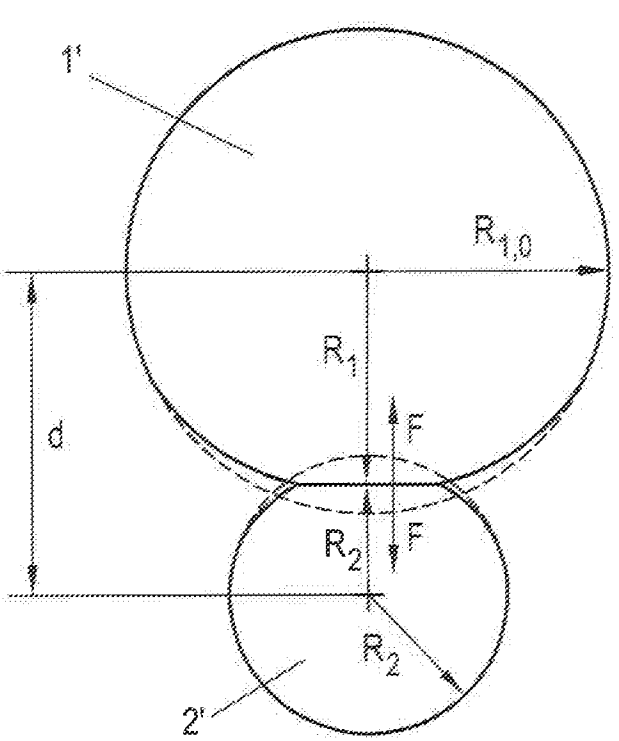
FIG. 11 shows a cross section of the roll pair from FIG. 10, in which an elastic deformation occurs due to the action of a contact force.
Figure 10:
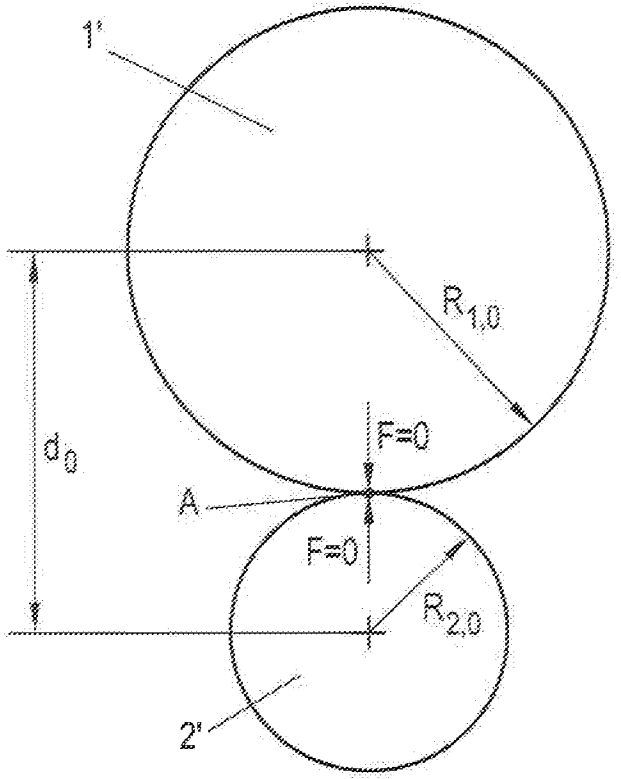
FIG. 10 shows a cross section of an idealized, nondeformed roll pair.

As two roll elements roll on one another, deformations occur, which are described in general hereafter with reference to FIGS. 10 and 11.

FIG. 10 shows an idealized roll pair composed of a first roll element 1' and a second roll element 2', which roll on one another at a contact point A (in relation to the illustrated cross section). The (nondeformed) normal radii $R_{1.0}$ of the first roll element 1' and $R_{2.0}$ of the second roll element 2' define the normal distance $d_0$ of the roll axles. The illustration in FIG. 10 corresponds to the situation in which no contact force F acts between the roll elements (F=0) and no elastic deformation of the roll elements occurs.

FIG. 11 schematically shows the deformation which occurs on the roll pair when the two roll elements 1', 2' are pressed against one another with a contact force F>0 (the deformations are shown greatly exaggerated in FIG. 11 for reasons of recognizability). The two roll elements no longer are in contact in a line (i.e., in a point in a cross section), but rather in a contact surface (which is shown as a line in the cross-sectional illustration in FIG. 11). The radii of the roll elements are also no longer constant, wherein the minimal radii $R_1$, $R_2$ are located in the middle of the contact surfaces. The distance of the roll axles d in the deformed state is therefore less than the normal distance $d_0$. The peripheral velocity at the contact surface therefore also no longer corresponds to the value computed on the basis of the idealized representation. Similar considerations also apply if one roll element rolls on a flat counter surface with elastic deformation.

Figure 1:
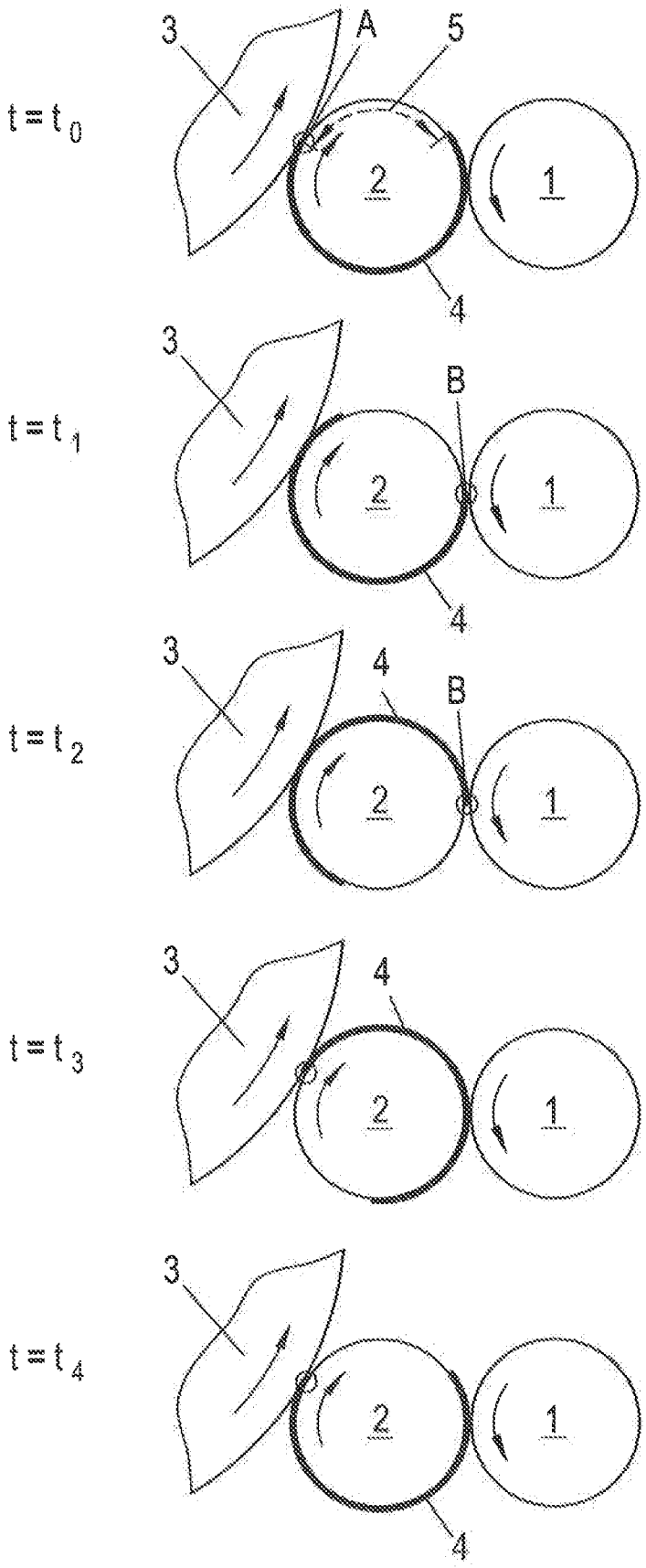
FIG. 1 shows a schematic illustration of the printing procedure of a flexographic printing press.

Such deformations of roll elements rolling on one another are not always accurately predictable in practice and determining the accurate extent of the deformation by means of measuring methods is very complex and often cannot be carried out in practice. However, since the deformation often has immediate effects on the product quality, the inventive method is directed to minimizing the quality flaws which arise from these deformations. The invention will be described hereafter on the basis of an exemplary application in printing technology, FIG. 1 shows the roll arrangement of a flexographic printing press, consisting of an anilox roll 1, a form cylinder 2, and a counter pressure cylinder 3, at five different points in time $t=t_0$ to $t_4$, which are each related to one revolution of the form cylinder 2.

Direct printing methods, for example, flexographic printing, have been generally routine and known for some time in the prior art, and therefore each individual component of the printing press will not be discussed herein. The illustration of some components was also omitted in FIG. 1 for the sake of comprehensibility, since they are well known to a person skilled in the art.

The form cylinder 2 bears a printing form 4 made of a flexible material, on which raised points define the regions to be printed according to the known flexographic printing method. The anilox roll 1 applies the printing ink to the raised points of the printing form 4. The printing ink is then applied to the printed material between the form cylinder 2 and the counter pressure cylinder 3.

Since the length of the printing form 4 can be shorter than the circumference of the form cylinder 2, there can in general be a region not covered by the printing form 4 on the form cylinder 2, which is also referred to herein as a printing gap 5. During a revolution of the form cylinder 2, i.e., during a printing cycle, it therefore, for example, passes through the following points in time $t=t_0$ to $t_4$:

$t_0$: The printing form 4 comes into contact with the counter pressure cylinder 3 at the contact point A between the form cylinder 2 and the counter pressure cylinder 3 (beginning of a printing cycle), while the anilox roll 1 is still in contact with the printing form 4;

$t_1$: The contact between anilox roll 1 and the printing form 4 applied to the form cylinder 2 ends at contact point B, while the counter pressure cylinder 3 is still in contact with the printing form 4;

$t_2$: After the printing gap 5, the anilox roll 1 moves back into contact with the printing form 4, while the counter pressure cylinder 3 is still in contact with the printing form 4;

$t_3$: The contact between counter pressure cylinder 3 and printing form 4 ends at contact point A, while the anilox roll 1 is still in contact with the printing form 4;

$t_4$: The counter pressure cylinder 3 (and/or the printed material carried thereon) moves back into contact with the printing form 4, while the anilox roll 1 is still in contact with the printing form 4. The location corresponds to the point in time $t_0$, wherein the printing cycle ends and a new printing cycle begins.

The arrangement illustrated in FIG. 1, which results in the described sequence of contact changes, is solely by way of example and is not restrictive. As is clear to a person skilled in the art, the printing form 4 can be shorter or longer and the relative arrangement of the roll elements in relation to one another can also differ. Such changes can also result in a different sequence of contact changes. For example, in the event of a shorter printing form 4 and a corresponding roll arrangement, a time window could occur in which neither the counter pressure cylinder 3, nor the anilox roll 1 is in contact with the printing form 4. On the other hand, it is also possible that the printing form 4 encloses the entire circumference of the form cylinder 2, so that no contact changes occur. The invention may also be advantageously applied to such cases.

In position-controlled or speed-controlled roll elements, the rotational velocities of the individual roll elements are adapted to one another on the basis of the respective diameter, so that no relative velocities exist between the roll elements in the contact points in the theoretical model. In practice, however, it has been shown that such relative velocities can occur in the contact point because of the elastic deformation of the roll elements. The drive torque is higher if both the anilox roll 1 and also the counter pressure cylinder 3 are simultaneously engaged with the form cylinder, and it is lower if no contact point of one or more roll elements is presently located in the region of the printing gap 5.

Figure 2:
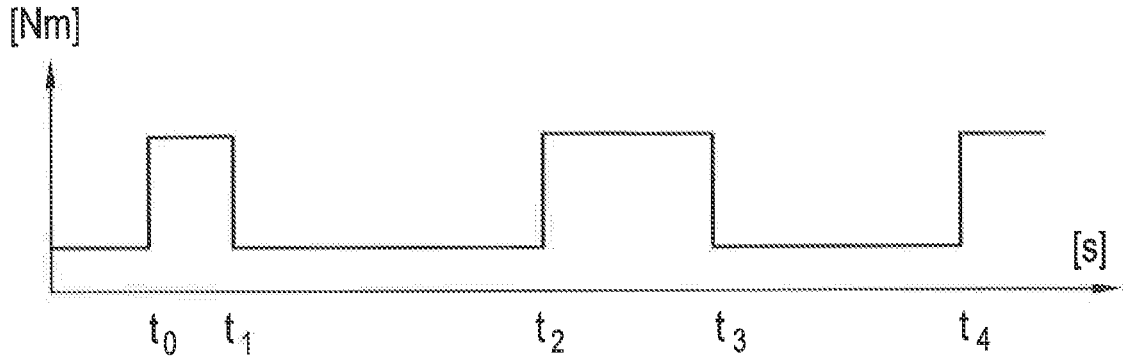
FIG. 2 shows a schematic illustration of the drive torque to be expected during a revolution of the form cylinder.

FIG. 2 shows a schematic illustration of the drive torque to be expected during a revolution of the form cylinder, in relation to the points in time $t_0$ to $t_4$, as shown in FIG. 1. This theoretical scheme can be used to analyze actual measurement results. It is to be noted that different roll arrangements and/or different lengths of the printing form 4 would result in different curves of the drive torque, wherein a person skilled in the art can readily transfer the teachings of the present application to such cases.

After these theoretical considerations, the invention will be explained on the basis of an experimental series carried out by the applicant and with reference to FIGS. 3 to 7 by way of example and in a nonrestrictive manner.

Figure 3:
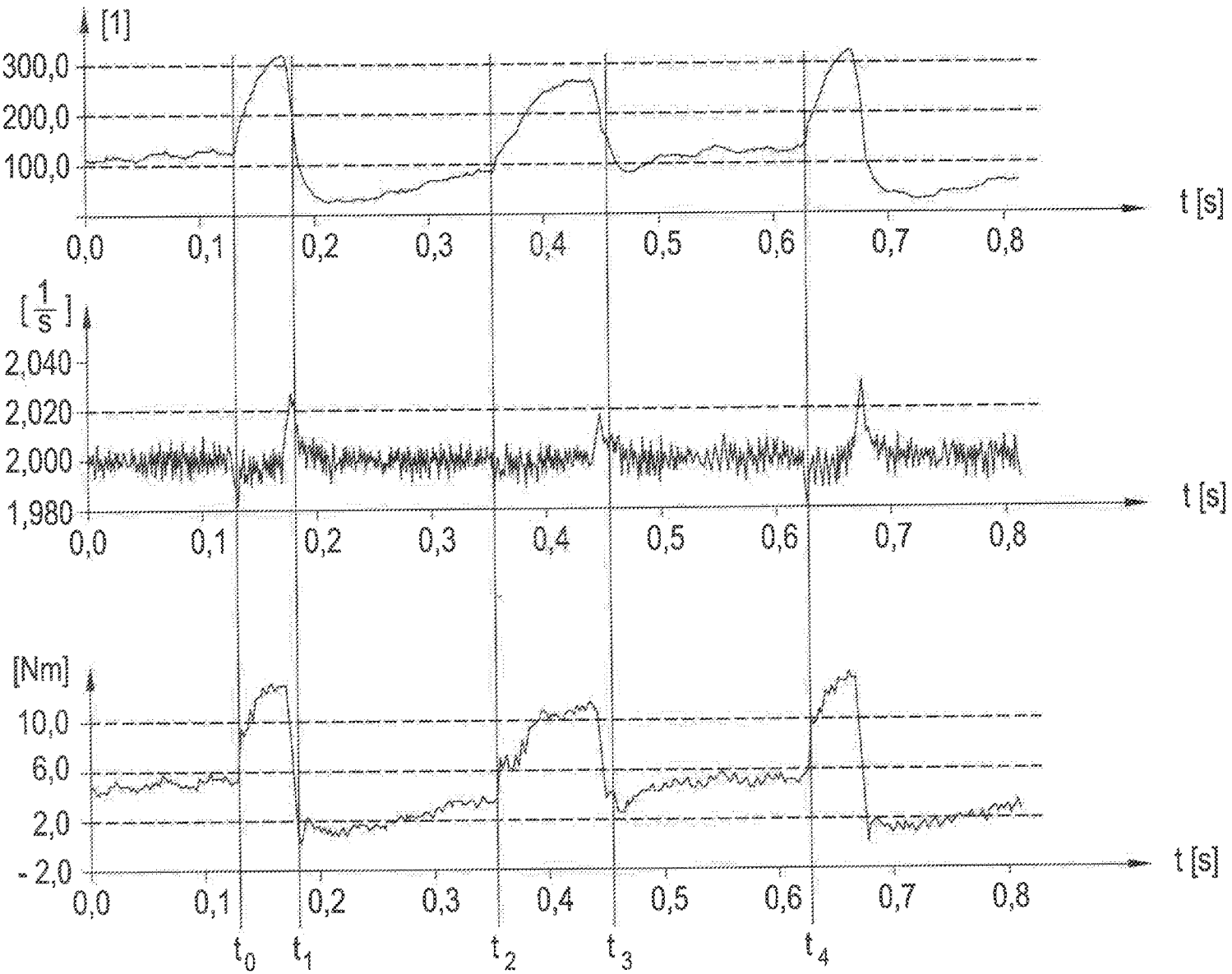
FIG. 3 shows a diagram of the dynamic behavior of a printing press in an experimental arrangement.

FIG. 3 shows a diagram of the dynamic behavior of the experimental arrangement, wherein the uppermost curve shows the drag error (difference between setpoint position and actual position in relation to the surface of the form cylinder), the middle curve shows the velocity curve, and the lowermost curve shows the drive torque of the form cylinder, wherein the points in time $t_0$ to $t_4$ during a revolution according to the illustrations in FIGS. 1 and 2 are shown in the diagram, The setpoint position corresponds in this case to the setpoint value of the position controller, the actual position was measured using an encoder. A non-constant curve of the drag error indicates that the peripheral velocities of the roll elements which are in contact do not match with one another.

The velocity curve has clearly pronounced and broad value peaks at the points in time $t_0$, $t_1$, $t_2$, and $t_4$ (whenever a roll pair engages or disengages).

Figure 4:
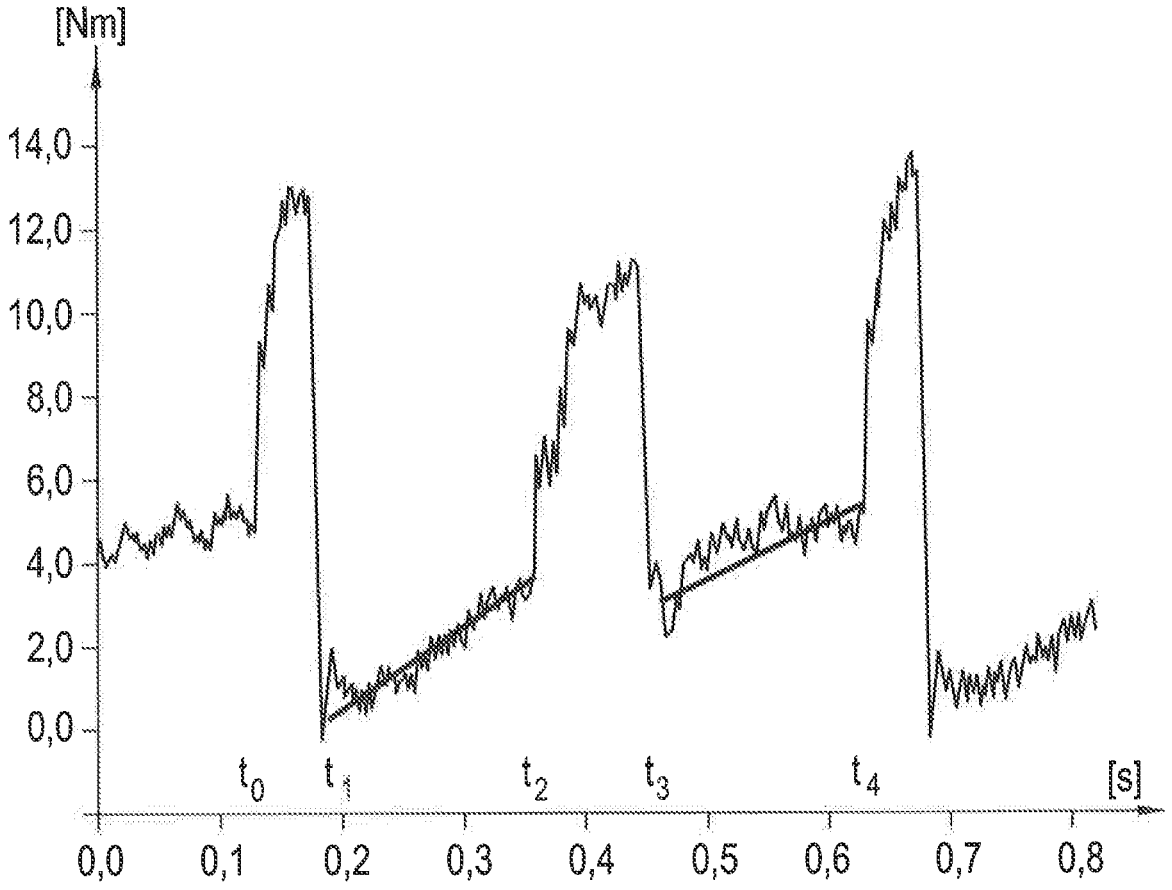
FIG. 4 shows an enlarged illustration of a subregion of the drive torque of FIG. 3.

The curve of the drive torque shown in FIG. 3 is shown once again enlarged in FIG. 4. It can be clearly recognized therein that the drive torque increases approximately linearly in each of the intervals $t_1$ to $t_2$ and $t_3$ to $t_4$. It was possible to show in the scope of the experiments that these increases of the drive torque are to be attributed to different peripheral velocities between the roll pairs, wherein the increase in the interval $t_1$ to $t_2$ is to be attributed to a velocity difference between counter pressure cylinder and form cylinder and the increase in the interval $t_3$ to $t_4$ is to be attributed to a velocity difference between anilox roll and form cylinder.

A strongly pronounced horizontal stripe was recognizable in the printed image at $t_1$, where the printing form cylinder loses the contact to the anilox cylinder, and a less pronounced, but still clearly visible horizontal stripe is recognizable at $t_2$, where printing form cylinder and anilox cylinder come back into contact with one another.

It was possible to show that the horizontal stripes arise in particular because of distorted pixels on the printed material, which are perceived as stripes in the event of a macroscopic observation of the printed image by the human eye.

An elastic deformation of the two roll elements (of the entire printing mechanism construction) occurs due to the contact force between the respective roll pairs (caused by the pressure provision). This elastic deformation in turn results in changed effective diameters of the respective roll elements which deviate from the diameters set by the machine operator. These effects can cause a peripheral velocity difference of the respective pairs, even if the rotational velocities are supposedly set correctly, and a direct measurement of the exact effective diameter values is not possible with running printing press.

This velocity difference has the result that a torque exchange between the roll elements takes place due to the contact of the roll elements, which is characterized in that the roll element rotating faster drives the roll element rotating slower and vice versa (the roll element rotating slower brakes the roll element rotating faster).

This results, in the contact phase of the two roll elements (when the printing form is engaged), in the case that the roll pairs are operated in a position-controlled manner, in the torque increasing over time on the roll element rotating faster, on the one hand, and in a torque decreasing over time on the roll element rotating slower, on the other hand. This is recognizable in the curve of the diagrams of FIGS. 3 and 4.

The effect of the torques building up and acting against one another over the time of the engagement is caused by the drag error of the associated drive control loops increasing over time.

At the end of the contact phase, the drag errors accumulated up to this point dissipate again and result in a compensation behavior determined by the interference behavior of the drive control loops (aperiodic decay or decay with damped oscillation). Depending on the compensation of a viewer (determined by the interference dynamic response of the closed drive control loop), stripes are caused in the printed image.

One consideration on which the invention is based is to prevent the occurrence of horizontal stripes in the printed image in that different peripheral velocities are recognized in roll pairs and the peripheral velocities of the roll pairs are automatically adapted to one another. For this purpose, the torque curves of the associated roll drives are analyzed in the context phase and the roll speeds are adapted until the peripheral velocities of the roll pairs correspond and essentially constant torque curves result in the middle of the contact phase.

Figure 5:
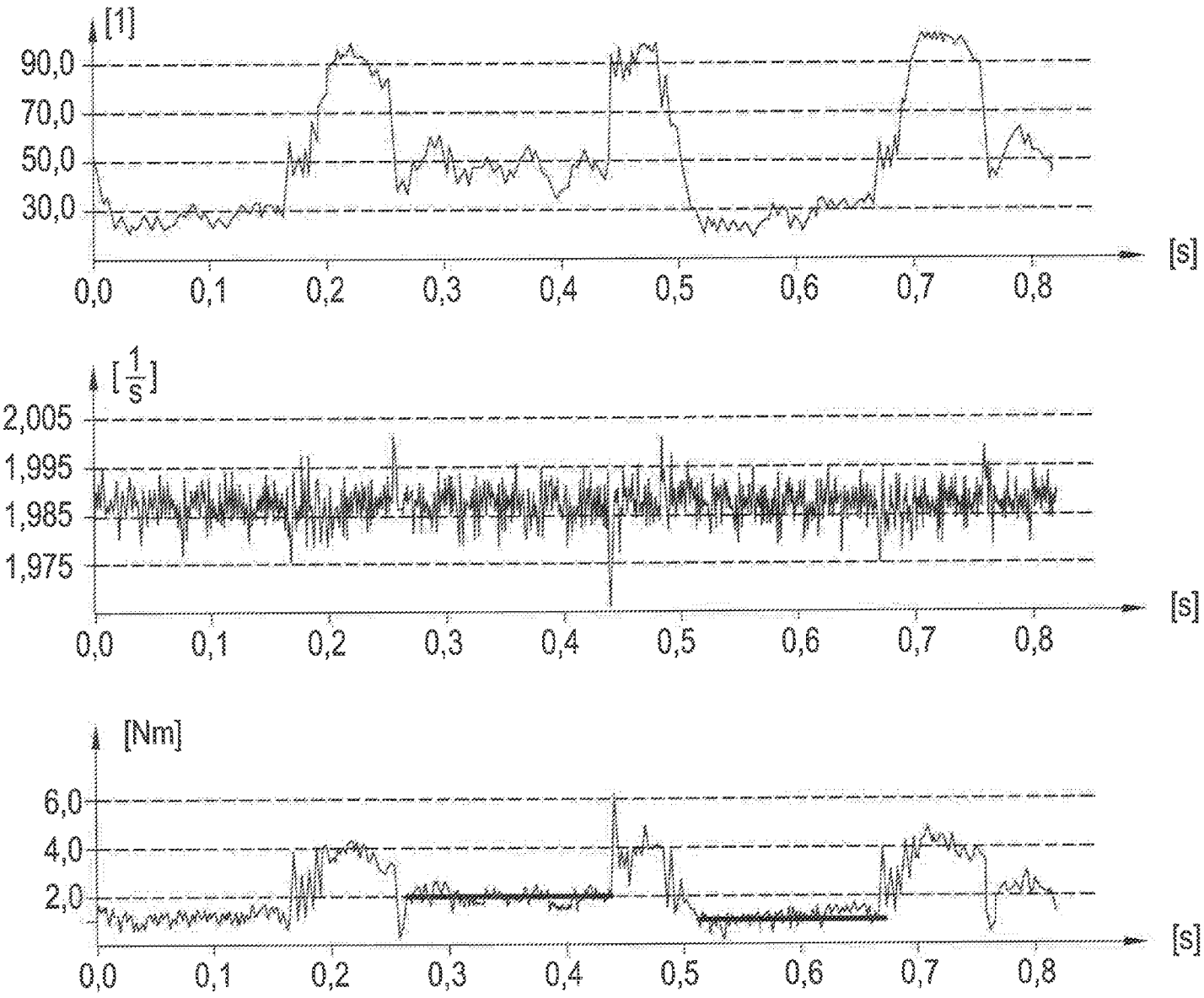
FIG. 5 shows a diagram of the dynamic behavior of the printing press in the experimental arrangement after a first adaptation of the specified value for the diameter of the form cylinder.

The peripheral velocities of the roll elements can be adapted, for example, by a change of the specified value for the roll diameter, in a further test run, the specified value for the diameter of the form cylinder was therefore increased in a first step by 0.6%, to achieve a correspondingly lower peripheral velocity of the form cylinder. FIG. 5 shows a diagram of the dynamic behavior of the printing press in the above-described experimental arrangement after this adaptation of the specified value for the diameter of the form cylinder by +0.6%. It can be seen clearly that the drive torque has significantly reduced value peaks (approximately 6 Nm in FIG. 5 in relation to approximately 13 Nm in FIG. 4) and a reduced average value. Furthermore, the drive torque has a consistent curve on average in the subintervals of the contact phases (intervals $t_1$ to $t_2$ and $t_3$ to $t_4$). Horizontal stripes could no longer be seen in the printed image.

The conclusion was drawn from the above considerations that an adaptation of the peripheral velocities as a function of the curve of the drive torque can prevent printing errors, and in particular the formation of horizontal stripes. This adaptation can take place automatically, wherein, for example, the slope of the drive torque in the "constant" regions (i.e., the regions in which no change occurs at the contact points A and B, cf. FIG. 1) is analyzed, and the peripheral velocity (velocities) of the roll(s) is (are) adapted accordingly, for example, by way of a change of specified values for the roll diameter or diameters.

The equalization of the peripheral velocities of the roll pairs can be achieved not only by way of a change of the speed of one of the participating roll elements, but rather a change of the infeed between the roll pairs can also be performed to influence the desired length of the printed motif on the substrate and thus compensate for distortions which can result in the printed image.

In a further approach for improving the printed image, an attempt was made to implement a dynamic adaptation of the drive control as a function of the curve of the drive torque. For this purpose, the consistency of the roll velocity was enhanced with the aid of a repetitive control method.

A high quality of the printed image is first inventively achieved by an enhanced consistency of the roll velocities with the aid of the repetitive control method by an additive current activation. The repetitive control method can be executed in a self-learning manner in principle and is therefore very easily applicable.

Figure 6:
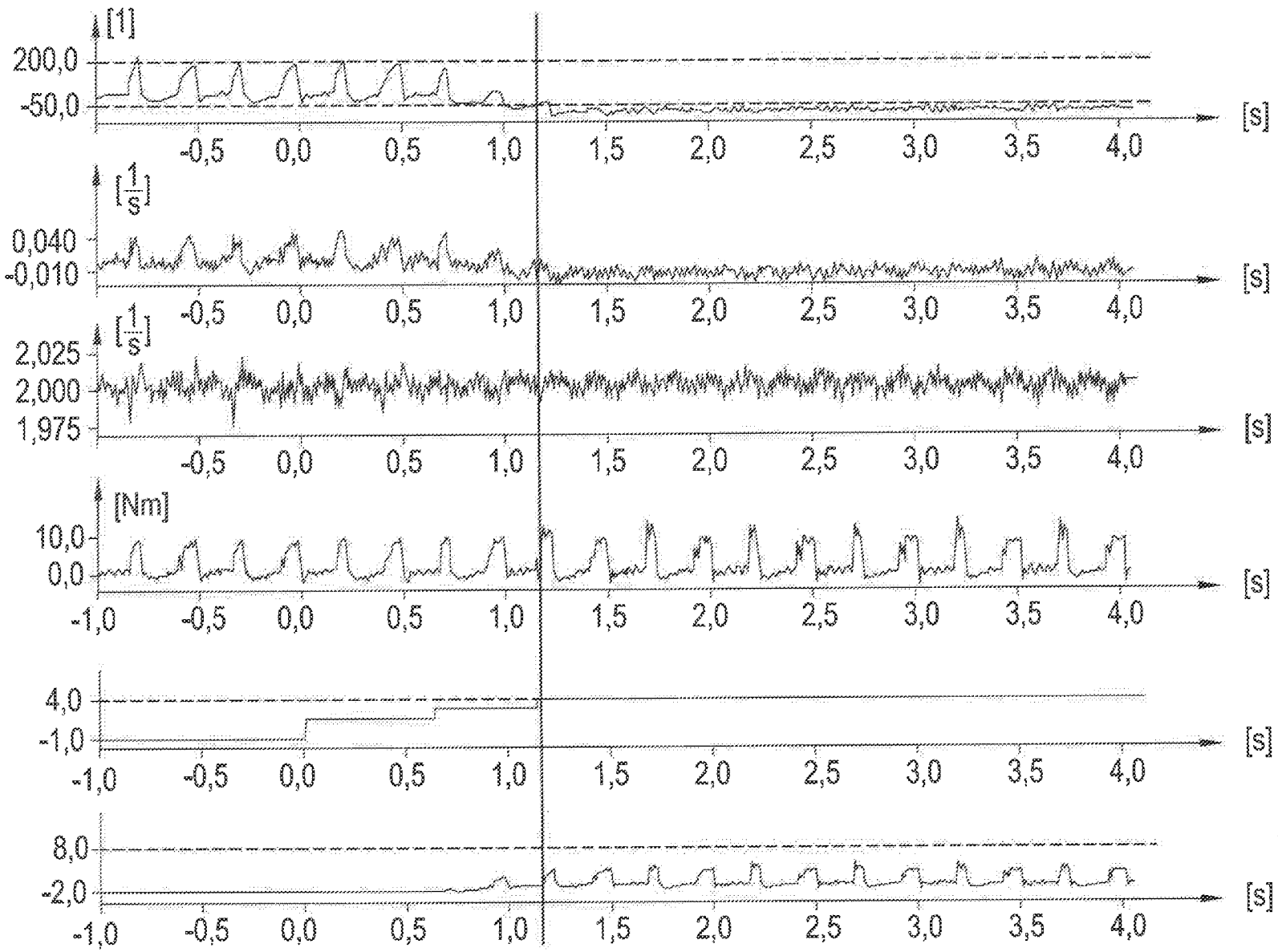
FIG. 6 shows a diagram of the dynamic behavior of the printing press in the experimental arrangement upon a use of a repetitive control method.

FIG. 6 shows a diagram of the dynamic behavior of the experimental arrangement if the RC method is applied. The specified value for the roll diameter was not changed in relation to the starting value (FIGS. 3 and 4). The curves of the following values are indicated in FIG. 6, from top to bottom:

- drag error
- speed error
- speed
- drive torque
- status of the RC controller (0: not active, 2 and 3: initialization phases, 4: active)
- starting value of RC controller (additive current activation)

After the activation of the RC controller (status=4) it can be seen that the actual speed does not have relevant value peaks and can therefore be considered to be constant. The drag error was also massively reduced. Nonetheless, the curve of the drive torque shows that it is always positive and a continuous increase occurred in the contact phases. In spite of the substantial improvements, stripes were noticeable in the printed image, although to a lesser extent than before the use of the RC controller.

Figure 7:
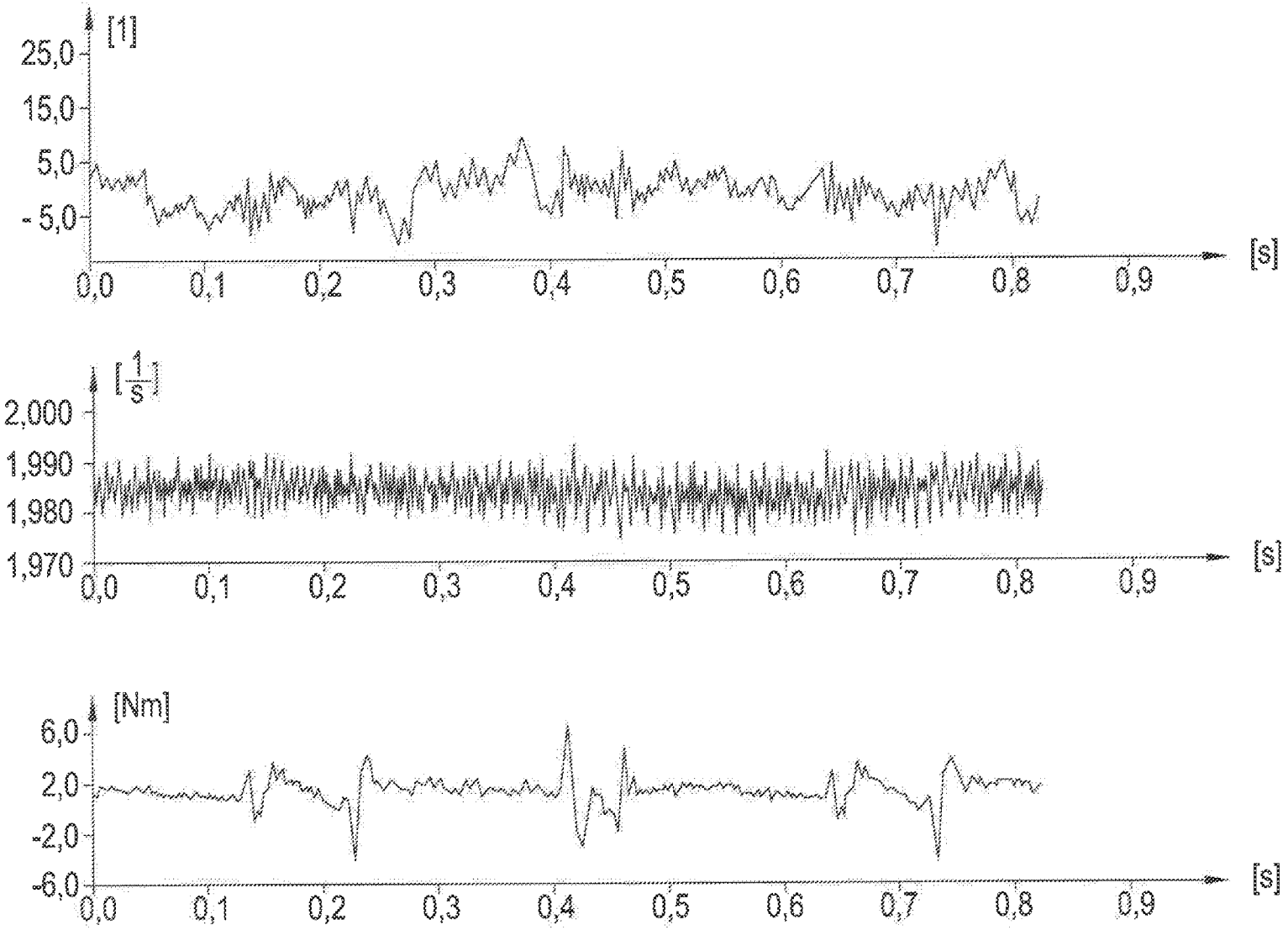
FIG. 7 shows a diagram of the dynamic behavior of the printing press in the experimental arrangement after a second adaptation of the specified value for the diameter of the form cylinder, wherein a repetitive control method was additionally applied.

To nonetheless be able to use the recognizable advantages of the RC controller, further experiments were carried out, wherein the adaptation of the specified values for the roll velocity and the RC, controller were combined. The measurement result of this experiment is shown in FIG. 7. FIG. 7 shows an approximately constant velocity curve having a very small drag error and low drive torque. No horizontal stripes were recognizable in the printed image.

Figure 8:
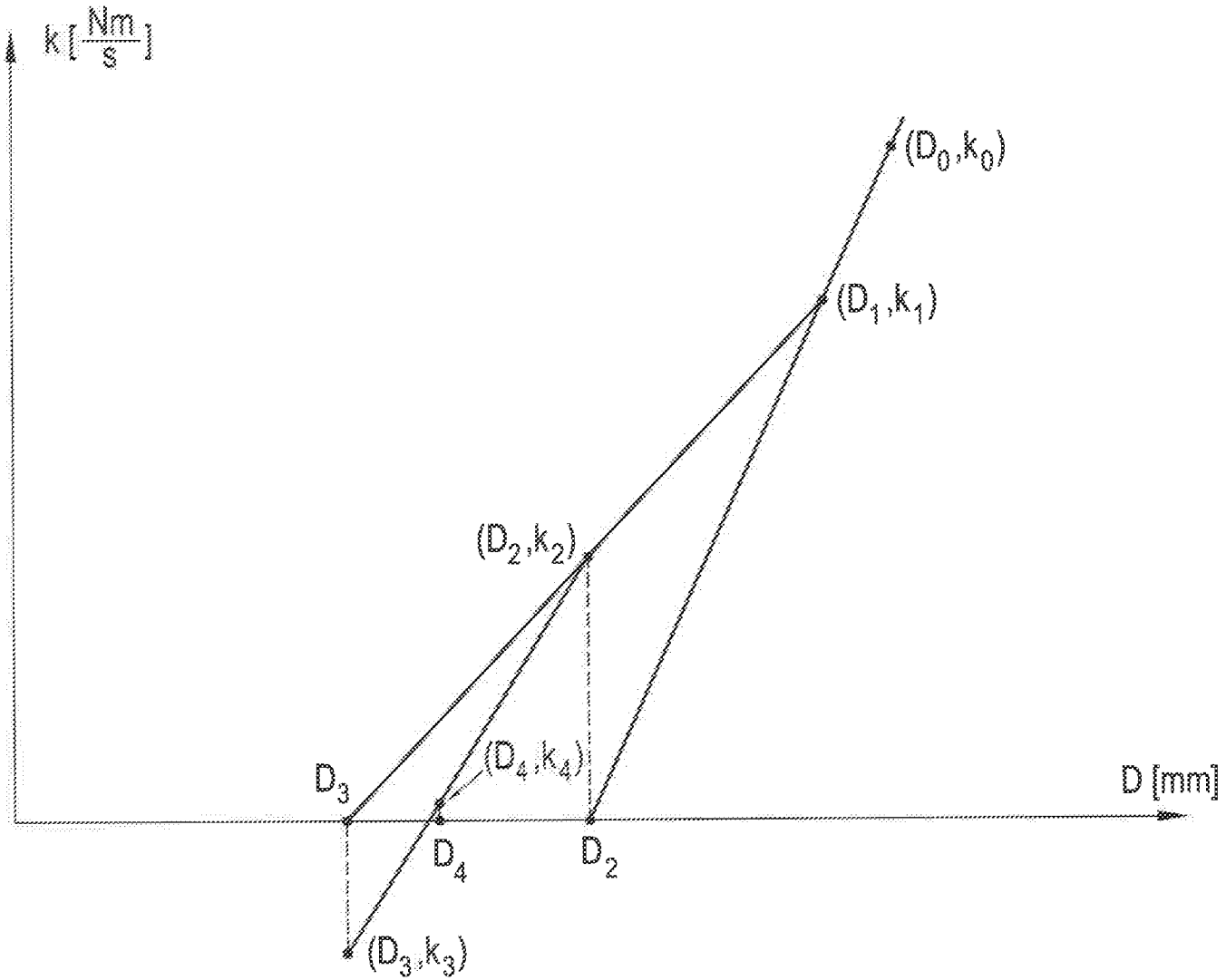
FIG. 8 shows a diagram which illustrates the iterative functionality of the shooting method by successive interpolations and extrapolations.

FIG. 8 illustrates the iterative functionality of a shooting method, using which an optimum specified value for the diameter of a roll element can be ascertained. Proceeding from a starting value $D_0$ for the diameter, a corresponding value $k_0$ is determined for the slope of the torque (this corresponds, for example, to the slope shown in FIG. 4 between the points in time $t_1$ and $t_2$). Thereafter, the starting value $D_0$ is changed slightly to the value $D_1$ and the corresponding value $k_1$ of the slope of the torque is determined. The next specified value D2 for the diameter is then determined as the intersection of the line through the points ($D_0$, $k_0$) and ($D_1$, $k_1$) with the abscissa axis. The method is continued iteratively until a specified value $D_x$ is found, for which the slope of the torque $k_x$ is sufficiently small. In FIG. 8, this is the case at the value $D_4$, which only still has a very small slope $k_4$.

The shooting method can be applied to various specified values, wherein it can run automatically at the beginning of each printing procedure.

Although the above-described examples of the inventive method have each been described on the basis of a control of the form cylinder, it is clear to a person skilled in the art that the other roll elements participating in the printing procedure, such as the anilox roll, the counter pressure cylinder, or further interconnected roll elements, can be optimized in a similar manner to improve the printed image.

Figure 9:
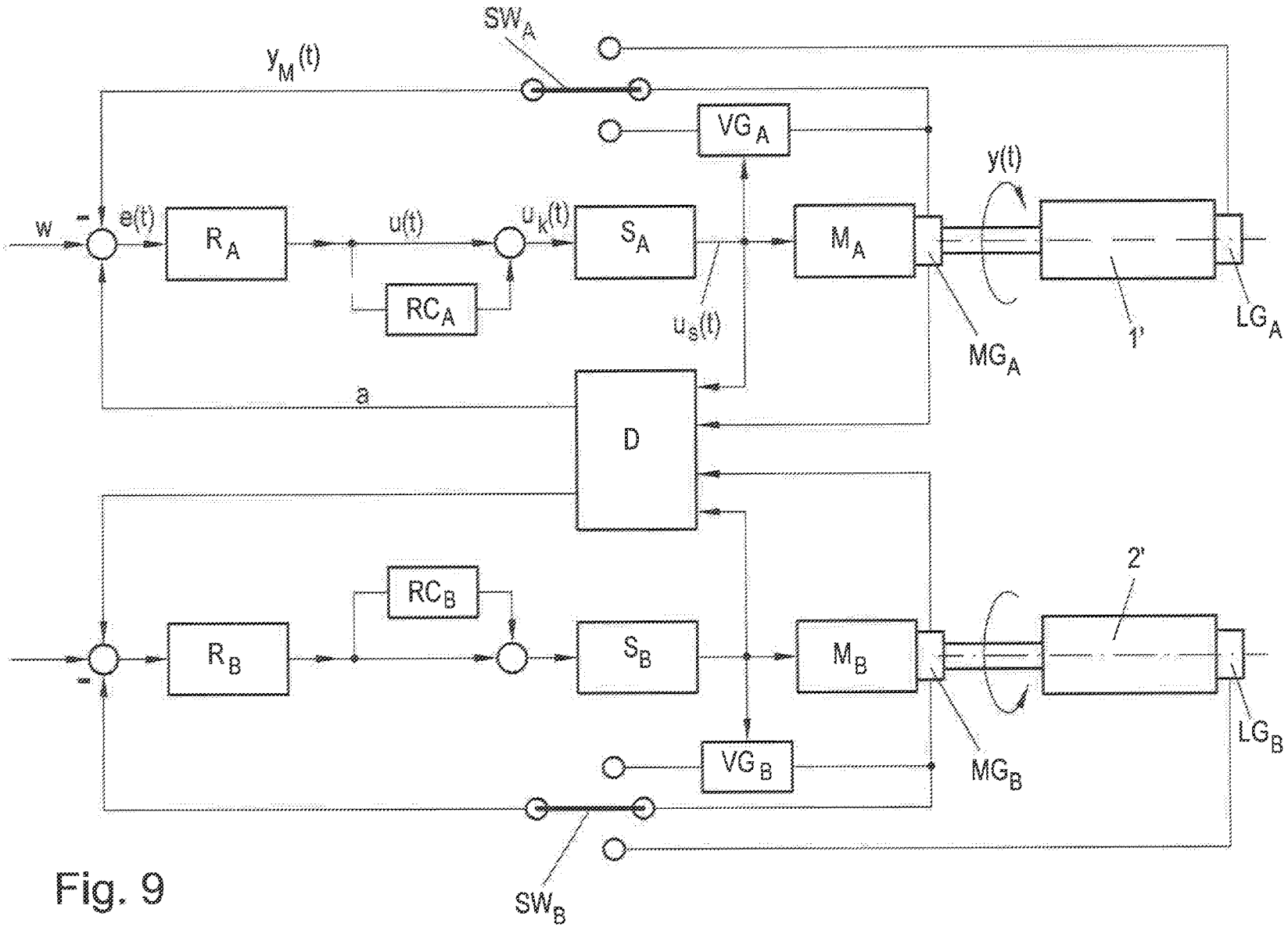
FIG. 9 shows a diagram of an exemplary inventive control loop for two roll elements rolling on one another.

FIG. 9 shows an exemplary control loop for the drive control of two roll elements 1' and 2' rolling on one another, which are each driven by one drive motor $M_A$, $M_B$. The two drive motors are each controlled via one control loop, wherein the function of the controller will be described hereafter with reference to the first roll element 1'.

The setpoint value w corresponds to the specified value for the motor speed, wherein this setpoint value w is based on the dimensions of the nondeformed roll elements. This setpoint value is corrected, on the one hand, by an adaptation value a, which was determined according to the speed correction method. The determination of the adaptation value is performed by the speed equalization D, which is described in greater detail hereafter. The return $y_M(t)$ is subtracted from the setpoint value w corrected by the adaptation value a, in order to determine the control deviation e(t), which represents the input value in a speed controller $R_A$. The speed controller $R_A$ outputs a control variable u(t).

The control variable u(t) is stored in the internal memory by a repetitive controller $RC_A$, which has an internal memory, in at least a first revolution cycle, wherein the repetitive controller $RC_A$ outputs a correction signal k(t) in a subsequent revolution cycle on the basis of the stored values.

The correction signal k(t) is linked to the control variable u(t) to form a corrected control variable $u_k(t)$. A current controller $S_A$ produces a positioning variable $u_s(t)$, which activates the drive motor $M_A$ in the form of a drive current, for example, on the basis of the corrected control variable $u_k(t)$.

The repetitive controller ($RC_A$) thus uses the speed error scaled by the speed controller amplification as an input variable and attempts to control the speed error during a revolution down to zero. This case is shown in the block diagram. Alternatively, the speed setpoint value can be specified by a higher-order position controller, the actual value of which is the integrated value of the return $y_M(t)$. In this case, the use of the drag error scaled with the position controller amplification can be useful. The RC then attempts to control the drag error curve constantly to zero during a revolution.

The control variable y(t) is the speed of the roll element 1'. To produce the return $y_M(t)$ from this control variable y(t), the control loop of FIG. 9 offers three options:

The speed can be measured either via a motor encoder $MG_A$ provided on the drive motor, or via a load encoder $LG_A$ arranged on the roll element 1'. Alternatively thereto, the return $y_M(t)$ can be produced by a virtual load encoder $VG_A$. The virtual load encoder produces an estimated value for the control variable y(t) on the basis of the positioning variable $u_s(t)$, which is based on the current or the motor torque (i.e., the positioning variable $u_s(t)$), the motor-side speed, and a model of the dynamic behavior between motor encoder and load encoder.

The type of the return can be selected via a selection switch $SW_A$.

The control loop of the second roll element 2' has the same elements once again and functions in a similar manner as described above for the first roll element 1'. The elements of the control loop which are to be associated with the second roll element 2' are identified in FIG. 9 by a subscript B, in contrast, the elements to be associated with the first roll element 1' are identified by a subscript A. For the sake of comprehensibility, the variables or signals of the control loop w, e(t), u(t), $u_k(t)$, $u_s(t)$, y(t), $y_M(t)$, a are only indicated in FIG. 9 for the control loop of the first roll element 1' The control loop of the second roll element uses similar signals.

The two control loops are linked by the above-mentioned speed equalization D, which analyzes the values obtained on the basis of the positioning variable $u_s(t)$ (of both control loops) and/or the values obtained from the selected encoder signals according to the above-described speed correction method and produces the adaptation value a for both roll elements 1', 2'.

With a sufficiently fast current control loop (this condition is usually met), instead of the current actual value (i.e., the positioning variable 140), the current setpoint value (i.e., the corrected control variable $u_k(t)$) can be used for the virtual load encoder and the speed equalization.

The invention claimed is:

1. A method for controlling a drive of a machine having at least one first roll element, which rolls with a surface on a counter surface at least in subintervals of a revolution cycle with the action of a contact force under elastic deformation, comprising:

a speed correction method, which automatically compensates for deformation related deviations of a peripheral velocity of the first roll element by way of an adaptation of a setpoint value for the velocity of the first roll element, and a retrospective method, which automatically compensates for deviations of a speed consistency of the first roll element within a revolution cycle by applying a correction signal determined from a curve of a control variable in a preceding revolution cycle or in multiple preceding revolution cycles, are applied in combination.

2. The method as claimed in claim 1, wherein, for the speed correction method, a time curve of a value characteristic of a drive torque of a roll arrangement is determined in at least one of the subintervals, a parameter for an increase of the value characteristic of the drive torque of the roll arrangement in the at least one of the subintervals is derived therefrom, and a guide variable of the peripheral velocity of the first roll element is adapted as a function of the derived parameter for the increase of the value characteristic of the drive torque of the roll arrangement in the at least one of the subintervals to minimize the increase.

3. The method as claimed in claim 2, wherein the parameter of the value characteristic of the drive torque is derived from the drive torque of the roll arrangement or from a variable physically proportional to the drive torque.

4. The method as claimed in claim 3, wherein the variable is physically proportional to the drive current or the drive power.

5. The method as claimed in claim 2, wherein the value characteristic of the drive torque of the roll arrangement is a force applied by the first roll element onto the counter surface.

6. The method as claimed in claim 2, wherein the derived parameter for the increase of the value characteristic of the drive torque of the roll arrangement in the at least one of the subintervals is a value averaged in the at least one subinterval.

7. The method as claimed in claim 2, wherein the derived parameter for the increase of the value characteristic of the drive torque of the roll arrangement in the at least one of the subintervals is a possibly smoothed slope of the drive torque of the roll arrangement in the at least one subinterval.

8. The method as claimed in claim 1, wherein the peripheral velocity of the first roll element is adapted by a change of a specified value for the velocity of the first roll element.

9. The method as claimed in claim 1, wherein the peripheral velocity of the first roll element is adapted by a change of a specified value for a diameter of the first roll element.

10. The method as claimed in claim 1, wherein the peripheral velocity of the first roll element is adapted by changing a specified value for a infeed of the first roll element.

11. The method as claimed in claim 1, wherein the retrospective method is a self-learning method for controlling cyclic sequences.

12. The method as claimed in claim 11, wherein the self-learning method for controlling cyclic sequences is a repetitive control method.

13. The method as claimed in claim 1, wherein the retrospective method uses a speed error which is scaled with a speed controller amplification as an input signal.

14. The method as claimed in claim 1, wherein the retrospective method passes through an initialization phase over at least one revolution cycle.

15. The method as claimed in claim 14, wherein the at least one revolution cycle is greater than at least two revolution cycles.

16. The method as claimed in claim 1, wherein the counter surface is formed by a surface of a second roll element, wherein the first roll element and the second roll element roll on one another, and wherein the second roll element includes a second drive that is controlled in a manner similar to that of the first roll element.

17. The method as claimed in claim 16, wherein the retrospective method uses a periodic drag error occurring in a contact point between the first roll element and the second roll element as the control variable.

18. The method as claimed in claim 1, wherein the machine is a printing press, wherein the first roll element is a form cylinder, wherein a counter pressure cylinder and an anilox roll on the form cylinder, and wherein an elastic printing form is applied to the form cylinder, which is in contact with at least one of the anilox roll or the counter pressure cylinder during at least one subinterval of a revolution of the form cylinder.

19. The method as claimed in claim 18, wherein the method is automatically executed during a printing procedure.

20. The method as claimed in claim 18, wherein the method is regularly executed during a printing procedure.

21. The method as claimed in claim 18, wherein an identical linear velocity is set by the adaptation of the peripheral velocity (velocities) to a machine having multiple printing mechanisms.

22. The method as claimed in claim 1, wherein the correction signal is determined from the curve of an actual velocity or actual position of the first roll element.

* * * * *